US006474048B1

(12) United States Patent
Metzger et al.

(10) Patent No.: US 6,474,048 B1
(45) Date of Patent: Nov. 5, 2002

(54) AUTOMATIC ICE PRODUCING, BAGGING, AND DISPENSING MACHINE

(75) Inventors: Mark C. Metzger, Glendale, AZ (US); Shawn M. Stannard, Peoria, AZ (US); James Shaker, Chandler, AZ (US)

(73) Assignee: The Arctic Group, Inc., Winnipeg (CA)

( * ) Notice: Subject to any disclaimer, the term of this patent is extended or adjusted under 35 U.S.C. 154(b) by 0 days.

(21) Appl. No.: 09/692,380

(22) Filed: Oct. 19, 2000

(51) Int. Cl.[7] ..... B65B 1/36
(52) U.S. Cl. ..... 53/493; 53/503
(58) Field of Search ..... 53/55, 67, 127, 53/167, 493, 503, 507, 508, 570

(56) References Cited

U.S. PATENT DOCUMENTS 3,559,424 A * 2/1971 Nelson ..... 62/347
3,712,019 A * 1/1973 Lamka et al. ..... 53/29
3,807,193 A * 4/1974 McKenney et al. ..... 62/322
5,109,651 A * 5/1992 Stuart ..... 53/502
5,761,888 A * 6/1998 Haley ..... 53/502

* cited by examiner

*Primary Examiner*—Scott A. Smith
*Assistant Examiner*—Nathaniel Chukwurah
(74) *Attorney, Agent, or Firm*—Jeffrey D. Moy; Harry M. Weiss; Weiss, Moy & Harris, P.C.

(57) ABSTRACT

A machine that produces, dispenses and automatically bags ice. The machine will have at least one ice producing unit for producing ice. An auger mechanism is coupled to the ice producing unit for collecting and moving the ice that has been produced by the ice producing unit. A volumetric drum is coupled to the auger mechanism. The volumetric drum stores the ice moved by the auger mechanism and measures the amount of ice to be bagged by volume. A heat sealer coupled to the bagging mechanism is provided to seal the bag once the bag has been loaded with ice. The machine further has a freezer compartment which stores the bag when the bag has been loaded with ice and sealed. The machine has a monitoring and communication system which monitors operating conditions of the machine and sends information on the operation of the machine to the manufacturer.

25 Claims, 4 Drawing Sheets

AUTOMATIC ICE PRODUCING, BAGGING, AND DISPENSING MACHINE

BACKGROUND OF THE INVENTION

1. Field of the Invention

This invention relates to ice machines and, more specifically, to an ice machine that produces, dispenses and automatically bags the ice.

2. Description of the Prior Art

Presently, most convenient stores and supermarkets sell bagged ice. The bags of ice are generally produced and bagged at a separate location. The bags of ice are then shipped to the stores where the ice bags are placed in a freezer compartment. While this system does work there are numerous problems associated with it. First, the stores do not have the ability to produce and bag the ice. This means that bags of ice have to be brought to the store. Second, the stores must back stock bags of ice and have an employee monitor the number of bags that are currently available. This is very inconvenient for the stores since the bags of ice consume valuable freezer space. Furthermore, this could possible cause problems should an employee fail to properly monitor the freezer for the number of bags of ice currently available. Another problem is that since a person has to monitor the number of bags of ice in the freezer, the stores have to order additional bags of ice when the number gets too low. Even after ordering additional bags, it will still take several days before the freezer is restocked with ice bags. This is extremely problematic during high sales times like holidays or during violent storm conditions.

There are currently ice producing and bagging machines. Most of these machines are currently owned and operated by ice producing companies and not individual grocery or convenient stores. Even those that may be installed in individual grocery or convenient stores have several problems. First, most of these machines have no sensors or monitors to oversee the operation of the machine. Thus, the store owners who operate the machines have no idea if the machine is properly operating. Another problem with current machines is that they bag the ice based on weight instead of volume. If a large piece of ice falls on the scale, the scale may misread the weight causing the bag to be under loaded. Likewise, bags may be overloaded with ice if the container holding the ice is near it's weight limit and a large piece of ice is added to the container. A further problem is that some machines do not treat the water prior to making the ice. Thus, if the water source to the machine is contaminated, the ice that the machine produces will also be contaminated.

Therefore, a need existed to provide a machine that can be installed at convenient stores and supermarkets that is able to produce, bag, and dispense bags of ice. The machine must be able to monitor and record operating conditions. The machine must be able to communicate when certain operating conditions are not being met and when repairs are required. The machine must also be able to properly dispense bags of ice which are not under or over loaded with ice. The machine needs to be able to purify the water prior to producing the ice so that any bacteria or contaminants are destroyed.

SUMMARY OF THE INVENTION

In accordance with one embodiment of the present invention, it is an object of the present invention to provide a machine that can be installed at convenient stores and supermarkets that is able to produce, bag, and dispense bags of ice.

It is another object of the present invention to provide a machine that is able to produce, bag, and dispense bags of ice that is able to monitor and record operating conditions.

It is still another object of the present invention to provide a machine that is able to produce, bag, and dispense bags of ice that is able to communicate when certain operating conditions are not being met and when repairs are required.

It is yet another object of the present invention to provide a machine that is able to produce, bag, and dispense bags of ice that are not under or over loaded with ice.

It is yet another object of the present invention to provide a machine that is able to produce, bag, and dispense bags of ice that is able to purify the water prior to producing the ice so that any bacteria or contaminants are destroyed.

BRIEF DESCRIPTION OF THE PREFERRED EMBODIMENTS

In accordance with one embodiment of the present invention a machine that produces, dispenses and automatically bags ice is disclosed. The machine will have at least one ice producing unit for producing ice. An auger mechanism is coupled to the ice producing unit for collecting and moving the ice that has been produced by the ice producing unit. A volumetric drum is coupled to the auger mechanism. The volumetric drum stores the ice moved by the auger mechanism and measures the amount of ice to be bagged by volume. A bagging mechanism is coupled to the volumetric drum. The bagging mechanism provides and opens a bag to be loaded with the ice when the volumetric drum has been loaded with a predetermined amount of ice. A heat sealer coupled to the bagging mechanism is provided to seal the bag once the bag has been loaded with ice. The machine further has a freezer compartment which stores the bag when the bag has been loaded with ice and sealed. The machine has a monitoring and communication system which monitors operating conditions of the machine and sends information on the operation of the machine to the manufacturer.

The foregoing and other objects, features, and advantages of the invention will be apparent from the following, more particular, description of the preferred embodiments of the invention, as illustrated in the accompanying drawing.

DETAILED DESCRIPTION OF THE PREFERRED EMBODIMENT

Figure 1:
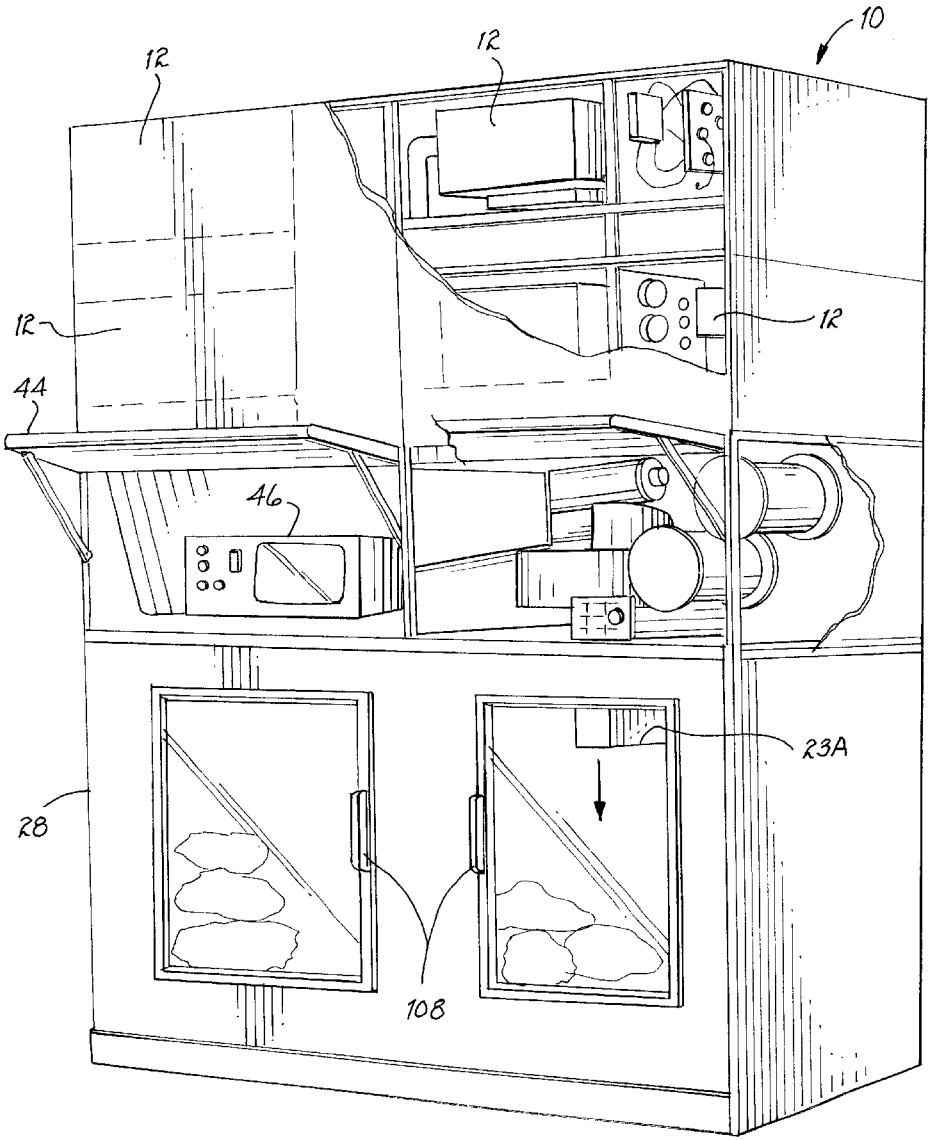
FIG. 1 is a perspective view of the ice producing, bagging, and dispensing machine of the present invention.

Referring to FIGS. 1–6, a machine for producing, bagging, and dispensing bags of ice 10 (hereinafter machine 10) will be described. The machine 10 is sized so as to allow the machine to be installed at your local supermarket or convenient store. The machine 10 uses a plurality of ice cube producing units 12. The machine 10 uses a plurality of ice cube producing units 12 so that there is a short cycle time and ice cubes can be produced and bagged on a fairly continuous basis. In the embodiment depicted in FIGS. 1 and 2, four ice cube producing units 12 are shown. If four ice cube producing units 12 are used, the machine 10 will be able to produce, bag, and dispense bags of ice on a one minute interval. However, the depiction of four ice cube producing units 12 should not be seen as to limit the scope of the present invention to just four units 12.

When an ice cube producing unit 12 has produced a batch of ice cubes, the ice cubes are sent down a tubing 14 to an auger mechanism 16. The auger mechanism 16 is comprised of a channeling 18. In the interior of the channeling is a pair of shanks 20. The shanks 20 are driven by a pair of motors 52 and 54 causing the shanks 20 to rotate. The rotation of the shanks 20 will level the ice cubes in the channeling 18 and move the ice cubes into a volumetric drum 22.

The machine 10 uses a volumetric drum 22 for measuring the amount of ice cubes to be bagged. The volumetric drum 22 is more accurate than the prior art machines which use scales and bag ice cubes based on weight. As stated above, if a large piece of ice falls on the scale, the scale may misread the weight causing the bag to be under loaded with ice cubes. Likewise, bags may be overloaded with ice if the container holding the ice is near it's weight limit and a large piece of ice is added to the container.

Figure 2:
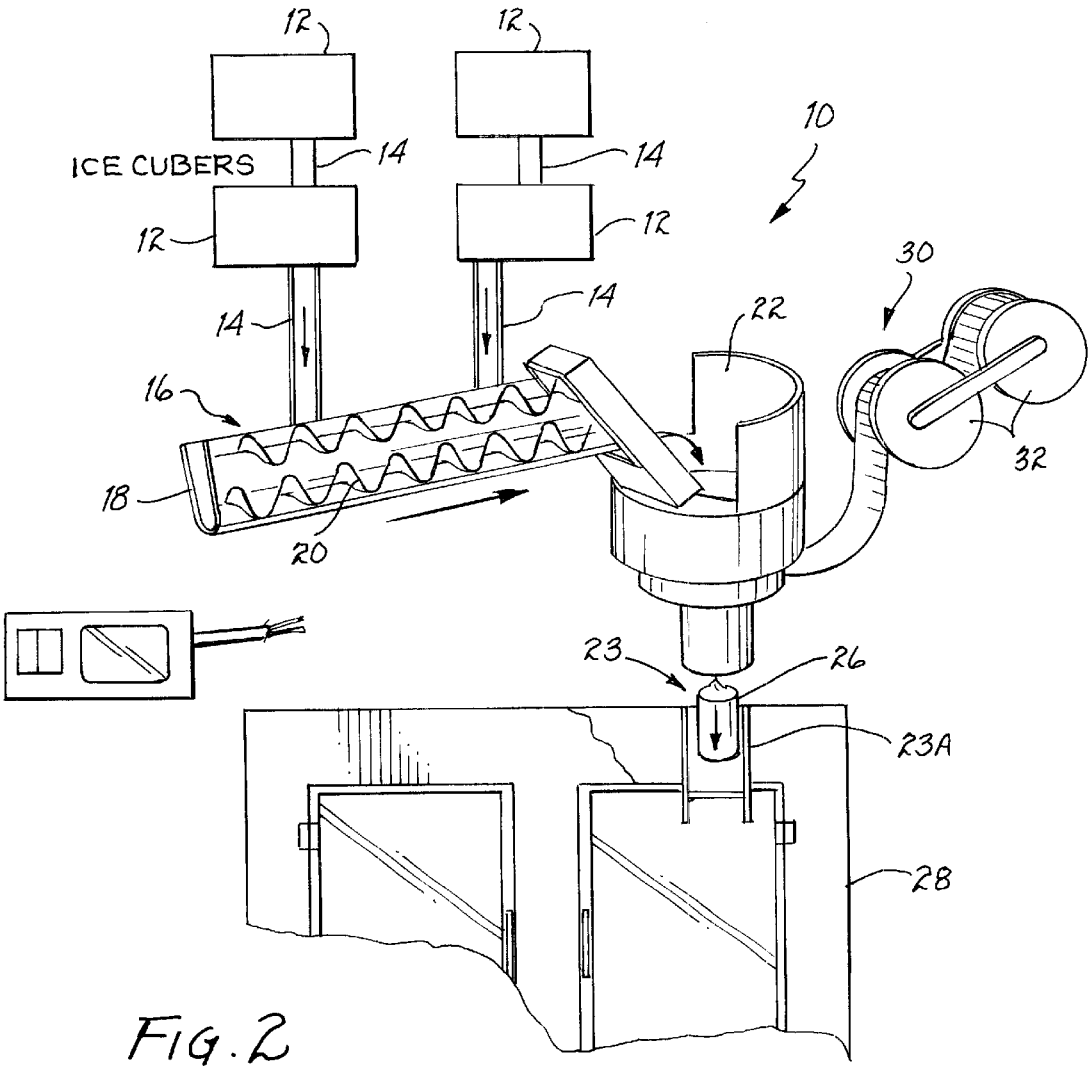
FIG. 2 is a simplified block diagram of the internal components which produce and bag the ice for the machine depicted in FIG. 1.
Figure 3:
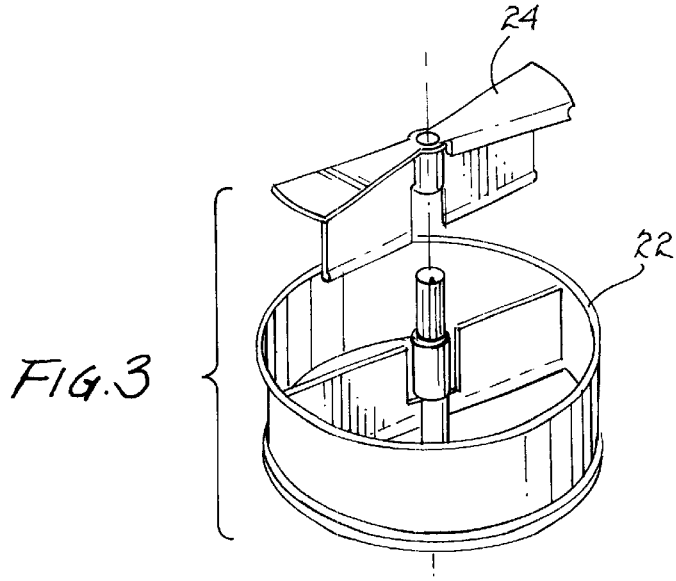
FIG. 3 is an exploded top view of a device used to determine the amount of ice to be dispensed into a volumetric container which is used in the machine depicted in FIG. 1.
Figure 4:
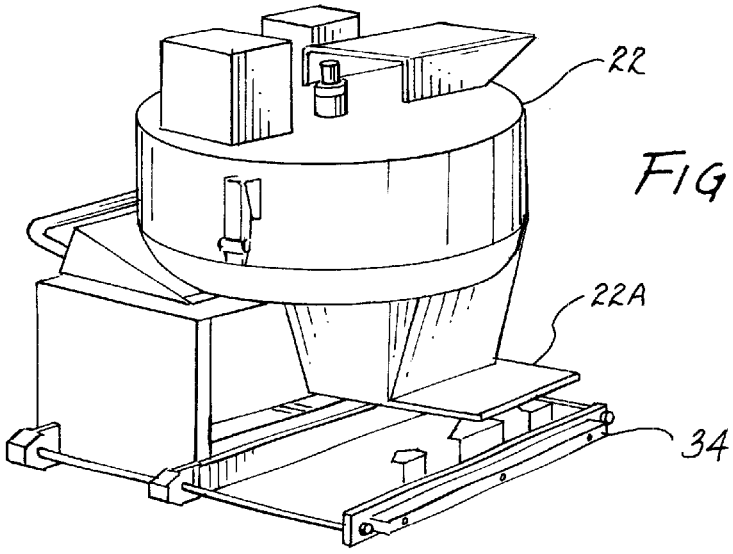
FIG. 4 is an elevated perspective view of the volumetric drum used in the machine depicted in FIG. 1.
Figure 5:
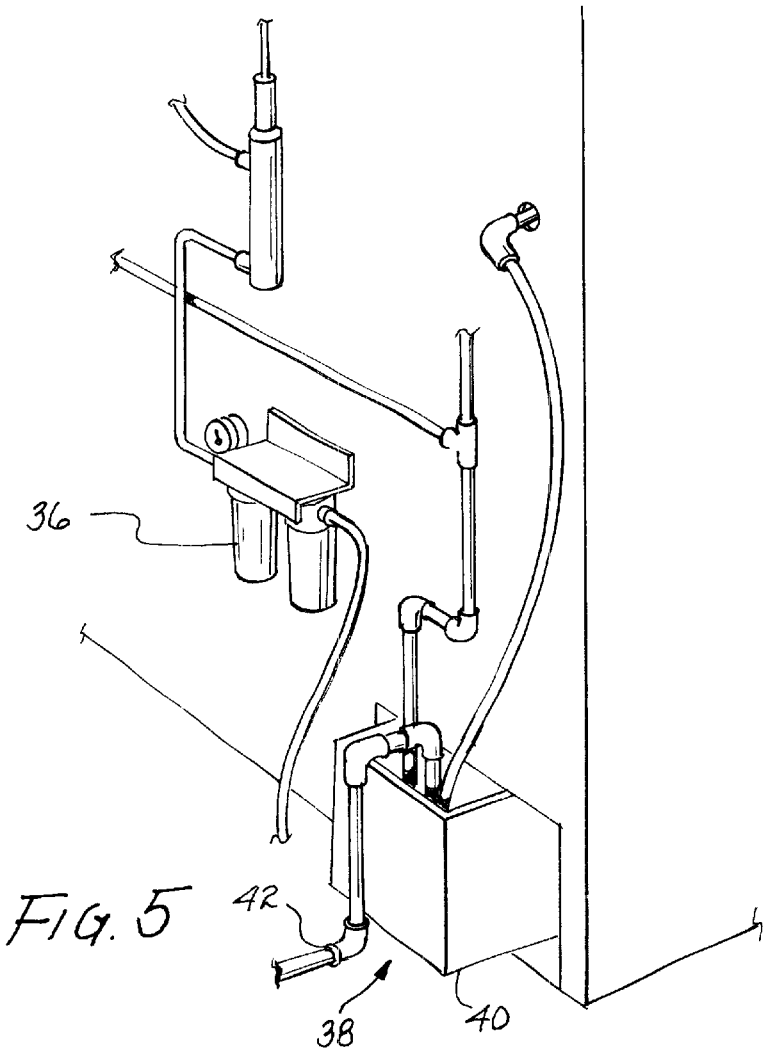
FIG. 5 is a back view of the machine depicted in FIG. 1 which shows the plumbing and purification system used.

Referring specifically to FIGS. 2–4, the volumetric drum 22 has an adjustment mechanism 24. The adjustment mechanism 24 allows the user to determine how much ice (by volume) will be loaded into each bag. Once the auger mechanism 16 has move the desired amount of ice cubes into the volumetric drum 22, the ice cubes will be deposited into a bag 26. The bag is then sealed and placed in the freezer compartment 28 of the machine 10.

The machine 10 uses a bagging mechanism 30 to bag the ice cubes once the volumetric drum 22 has been filled to the proper level. The bagging mechanism 30 has a plurality of bag rolls 32. Multiple bag rolls 32 are used so that the machine 10 may continuously bag ice cubes for longer periods of time without having to be shut down and reloaded with another roll of bags 32. Prior art machines only use a single roll and have to be reloaded on a fairly routine basis. Reloading a bag roll 32 is a time consuming process and is generally done by the machine manufacturer. Thus, by using multiple bag rolls 32, the manufacturer will not have to come to the store as often to service the machine 10.

In operation, the bagging mechanism 30 will advance a single bag 26. A blower 60 will then be activated to open the bag 26. Once the volumetric drum 22 has been filled to the proper level, the ice cubes will be loaded into the bag 26. The bag 26 is sealed by using a heat seal bar 34. The heat seal bar 34 is generally a heating element which may be quickly raised to a sufficient temperature to heat seal the bag 26. Once the bag 26 is sealed, the bag 26 will be deposited into the freezer department 28 of the machine 10.

The machine 10 has a water purification system 36. The water purification system 36 uses different filters to remove contaminates which may be found in the water supply. The water purification system 36 includes the use of an ultraviolet filter. The ultraviolet filter aids in the elimination of bacteria that may be found in some water supplies. The water purification system 36 allows the machine 10 to produce crystal clear ice which is attractive to consumers and refreshing to the taste.

Due to local health codes, stores which install devices similar to machine 10 need to be installed close to a floor drain. This is required so that excess water from these devices will flow into the floor drain. Unfortunately, floor drains may not be conveniently located in the area where the machine 10 is desired to be installed. If a floor drain is not located near the installation area, a person has two options. One is to install a floor drain. This is a fairly expensive and inconvenient option. The second option is to move the installation area to one near a floor drain.

The machine 10 comes equipped with a sump pump assembly 38. The sump pump assembly 38 has a reservoir 40 which will collect any moisture which drains from the machine 10 or which may be collected due to a leak or part failure. However, it should be noted that the machine 10 dramatically minimizes the amount of water leakage due to a part failure by a sensor monitor system which will be described later. Any water that is collected in the reservoir 40 is then pumped out of the reservoir 40 to a floor drain via the piping 42. The sump pump assembly 38 will allow the machine 10 to be installed in any location in a store thus avoiding the problems with prior art machines.

Located under a front cover 44 of the machine 10 is a monitoring and communication system 46. The monitoring and communication system 46 has a plurality of sensors which monitor the operating conditions of the machine 10. The monitoring and communication system 46 also has a communication device which will allow information to be transferred to and from the machine 10 to a remote monitoring location.

Figure 6:
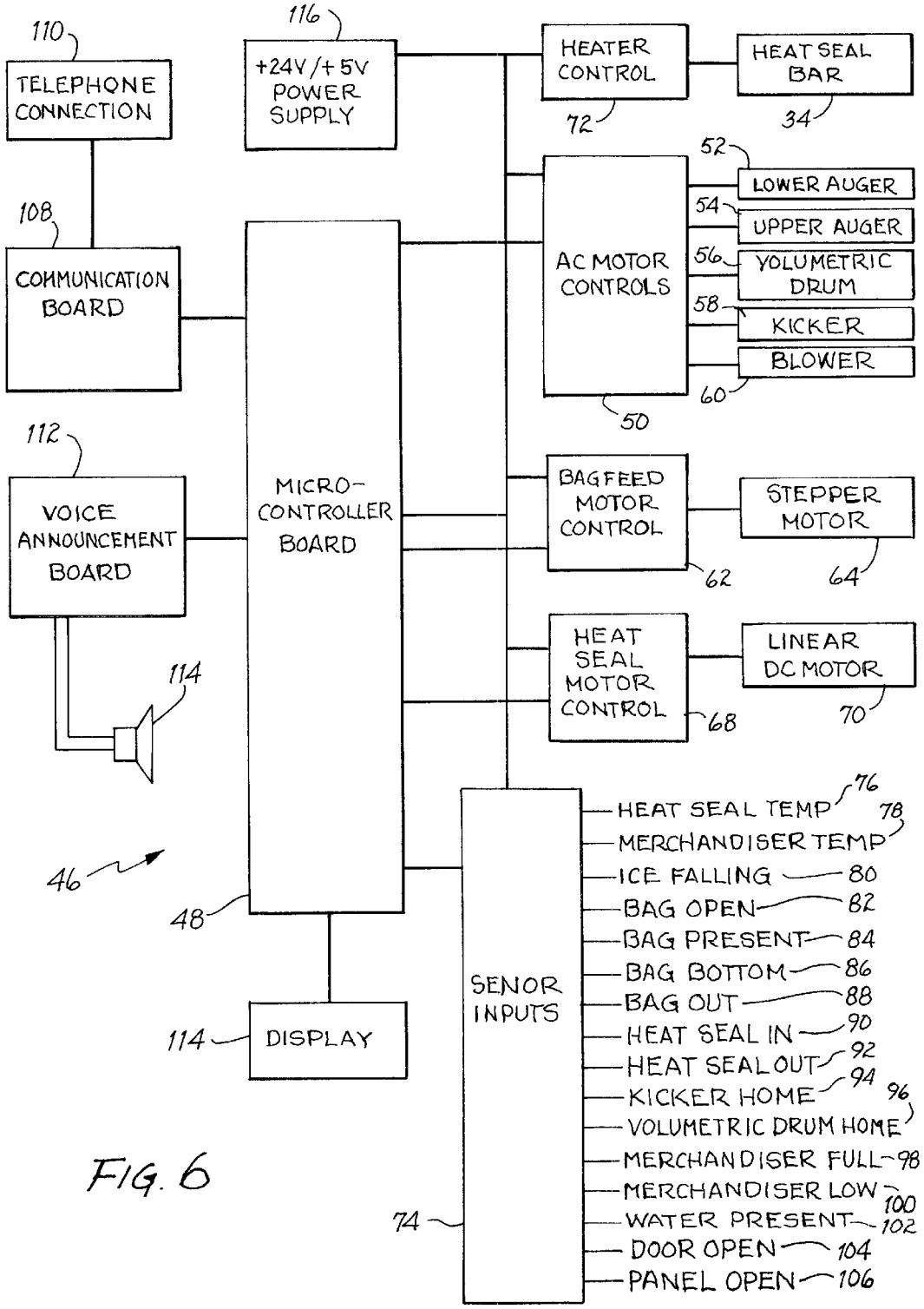
FIG. 6 is a simplified functional block diagram of the monitoring and communication system for the ice producing, bagging, and dispensing machine of the present invention.

Referring to FIG. 6, the monitoring and communication system 46 will be described in further detail. The monitoring and communication system 46 is powered by a power supply 116. The monitoring and communication system 46 has a microcontroller board 48. The microcontroller board 48 controls the operation of the monitoring and communication system 46. The microcontroller board 48 is able to do this by sending signals to and receiving signals from a plurality of controllers, sensors, and communication devices.

Coupled to the microcontroller board 48 is a motor controller 50. The motor controller 50 is used to activate and deactivate the various motors used in the machine 10. As can be seen in FIG. 6 and previously described above, the machine 10 uses motors to drive several different parts of the machine 10. The machine 10 has a first and second auger motor 52 and 54 respectively. The first auger motor 52 is used to move the ice cubes that are in the channeling 18 of the auger mechanism 16 to the volumetric drum 22. The first auger motor 52 will cause one of the shank 20 to rotate. The rotation of that shank 20 will move the ice cubes in the channeling 18 into the volumetric drum 22. The second auger motor 54 is used to level the ice cubes in the channeling 18 so that the ice cubes deposited in the channeling 18 do not build up in a single location. The second auger motor 52 will cause the second shank 20 to rotate. The rotation of the second shank 20 will level out and distribute the ice cubes in the channeling 18.

The motor controller 50 further controls a volumetric drum motor 56. Once the volumetric drum 22 is filled to the desired capacity (and the bag 26 is properly situated), the motor controller 50 will activate the volumetric drum motor 56. This will causing a bottom flap 22A on the volumetric drum 22 to open so that the ice cubes in the volumetric drum 22 may be loaded into the bag 26.

Once the bag 26 is filled with ice cubes and sealed, the bag is deposited into the freezer section 28 of the machine 10. However, in order to avoid all of the bags 26 from being deposited on a single side of the freezer 28, a kicker motor 58 is used. The kicker motor 58 will cause flaps 23A on a kicker assembly 23 to move from one side of the freezer 28 to the other. This will allow bags 26 to be evenly distributed on each side of the freezer 28.

Once the volumetric drum 22 is filled to the desired level, the bagging mechanism 30 will move a bag 26 into the proper location to be filled. For this to take place, the microcontroller board 48 will send a signal to a bag feed motor controller 62. The bag feed motor controller 62 will activate a stepper motor 64 which will cause the bagging mechanism 30 to advance a bag 26 from one of the bag rolls 32. The microcontroller board 48 will then signal the motor controller 50 to activate the blower 60 which will cause the bag 26 that was just advanced to open and in a position to be loaded with ice.

When the bag 26 is loaded with ice cubes, the bag is ready to be sealed. The bag 26 is sealed by using a heat seal bar 34. The heat seal bar 34 is generally a heating element which is set to a sufficient temperature to properly heat seal the bag 26. The microcontroller board 48 controls both a heat seal motor control 68 and a heater control 72. When a bag 26 is properly filled, the microcontroller board 48 will signal the heat seal motor control 68. The heat seal motor control 68 will activate a motor 70 which causes the heat seal bar 34 to close around the opening of the bag 26. When the heat seal bar is properly closed around the opening of the bag 26, the heating elements will seal the opening of the bag 26. Once the bag 26 is sealed, the heat seal bar 34 will be opened. The kicker motor 58 is then activated and places the bag 26 in the freezer 28 of the machine 10.

The microcontroller board 48 is coupled to a plurality of sensor inputs 74. The sensor inputs 74 allow the microcontroller board 48 to monitor the operation of the system 10 and to shut down the machine 10 in case a problem should arise. The machine 10 has a heat seal temperature sensor 76. The heat seal temperature sensor 76 will monitor the temperature of the heating elements in the heat seal bar 34 and notify the microcontroller board 48 if the heating element is broken or if the temperature is not at a sufficient level to properly seal the bag 26.

The machine 10 further has a merchandiser temperature sensor 78 which monitors the internal temperature of the freezer compartment 28 of the machine 10. If the temperature of the freezer compartment 28 rises above a threshold temperature, the merchandiser temperature sensor 78 will signal the microcontroller board 48. The microcontroller board 48 will then contact the manufacturer via the communication board 108 that servicing may be required.

An ice falling sensor 80 is provided on the machine 10 so that one can monitor that the ice producing units 12 are producing ice and that the ice is being deposited into the auger mechanism 16 and into the volumetric drum 22.

The bagging mechanism 30 uses a plurality of sensors which are also coupled to the microcontroller board 48 to allow one to monitor the operation of the bagging mechanism 30. The bagging mechanism has a bag open sensor 82. The bag open sensor 82 will monitor if the blower 60 has been activated and blown open the bag 26. If the bag 26 has not been blown open, the machine 10 will cycle again until the bag 26 has been properly blown open. A bag present sensor 84 will monitor if the bag 26 has been moved from the kicker assembly 23 and into the freezer 28. If a bag 26 is caught in the kicker assembly 23, the machine 10 will cycle again to try and deposit the bag 26 in the freezer department 28. If the bag 28 is still present in the kicker assembly 23 after a few cycles, the bag present sensor 84 will signal the microcontroller board 48. The microcontroller board 48 can then signal the manufacturer that service is required or sound an audible alarm to the store owner that the kicker assembly 23 is jammed. The bag bottom sensor 86 monitors whether the motor 64 has properly advanced the next bag 26 to be loaded. When the bag 26 has been properly advanced and is ready to be loaded, the bag bottom sensor 86 will signal the microcontroller board 48 of this condition. The bagging mechanism 30 also has a bag out sensor 88. The bag out sensor 88 will monitor when the bag rolls 32 are out of bags and that the machine 10 needs to be reloaded. If this signal is activated, the microcontroller board 48 will send a signal to the manufacturer that servicing is required. In the alternative, the microcontroller board 48 may send an audible message that the machine 10 needs to be reloaded with another bag roll 32.

The machine 10 also has a heat seal in sensor 90 and a heat seal out sensor 92. The heat seal in sensor 90 monitors the movement of the heat seal bar 34 as the heat seal bar 34 closes around the bag 26. The heat seal in sensor 90 will signal the microcontroller board 48 when heat seal bar 34 has properly closed around the opening of the bag 26. When this occurs, the heating elements in the heat seal bar 34 may now seal the bag 26. The heat seal out sensor 92 also monitors the movement of the heat seal bar 34. When the heat seal bar 34 has sealed the bag 26, the heat seal out sensor 92 will signal the microcontroller board when the heat seal bar 34 has sufficiently opened to release the bag. Once this is done, the kicker assembly 23 may deposit the bag 26 in the freezer 28.

The machine 10 further has a kicker home sensor 94. The kicker home sensor 94 monitors the position of the kicker assembly 23. If the kicker assembly 23 is not in the proper position to receive the bag 26, the kicker home sensor 94 will signal the microcontroller board 48 not to send a bag 26 to the kicker assembly 23. The microcontroller board 48 will then cycle again and wait for the proper signal from kicker home sensor 94. If no signal is ever received from the kicker home sensor 94, the microcontroller board 48 may send a signal to the manufacturer that servicing is required or sound an audible alarm to the store manager.

The volumetric drum 22 also has a sensor which is coupled to the microcontroller board. The volumetric drum 22 has a volumetric drum home sensor 96. The volumetric drum home sensor 96 basically monitors the level of ice in the volumetric drum 22. The volumetric drum home sensor 96 will signal the microcontroller board 48 when the volumetric drum 22 is full and that the ice cubes need to be deposited into the bag 26.

The freezer compartment 28 has a pair of sensors which monitor the level of bags 26 in the freezer compartment 28. The freezer compartment 28 has a merchandiser full sensor 98 and a merchandiser low sensor 100. When the bags of ice in the freezer compartment 28 has reached a predetermined level (merchandiser full level), the merchandiser full sensor 98 will signal the microcontroller board 48 that the freezer compartment 28 is full and that the machine 10 should stop producing and bagging ice. Whenever, the level of the bags of ice is below that predetermined level, the machine should be activate and producing and bagging ice. When the bags of ice have fallen below a predetermined level (merchandiser low level), the merchandiser low sensor 100 will signal the microcontroller board 48 that the freezer compartment 28 is low. When the merchandiser low sensor 100 is activated, the microcontroller board 48 will send a signal to the communication board 108. The communication board 108 will then contact the manufacturer informing them that the level of ice in machine 10 is low and that there may be a problem (i.e., not properly producing and bagging ice).

The machine 10 has a water present sensor 102 coupled to the microcontroller board 48. The water present sensor 102 will monitor whether the water level in the sump pump assembly 38 has reached a threshold level. If the water level has reached the threshold level, this generally means that the sump pump assembly 38 is not properly draining the water that has collected in the reservoir 40 or that water is building up in the sump pump assembly 38 faster than the water can be pumped out. The water present sensor 102 will then send a signal to the microcontroller board 48 informing the microcontroller board 48 to shut down the machine 10 until the reservoir 40 is properly drained.

The machine 10 further has a door open sensor 104 coupled to the microcontroller board 48. If one of the doors 108 is open, the door open sensor 104 will send a signal to the microcontroller board 48. The microcontroller board 48 will then ensure that no bags 26 are released from the kicker assembly 23. This helps to prevent a bag 26 from falling on the head of a consumer or operator of the machine 10. The machine also has a panel open sensor 106 coupled to the microcontroller board 48. The panel open sensor 106 monitors whether the panel 44 is open. Generally, the panel 44 is opened by a service representative who is going to service the machine 10. Thus, in accordance with one embodiment of the present invention, if the open panel sensor 106 is activated, the microcontroller board 48 will shut down power to the machine 10 so as to prevent injury during the servicing of the machine 10.

The monitoring and communication system 46 also has a communication board 108 coupled to the microcontroller board 48. The communication board 108 allows the machine 10 to communicate with the manufacturer via a telephone connection 110 which is coupled to the communication board 108. The machine 10 may then signal the manufacturer that the machine 10 has malfunctioned and that a service representative needs to be sent out. For example, if the heating element is broken or if the temperature is not at a sufficient level to properly close the bag 26, a signal from the heat seal temperature sensor 76 will be sent to the microcontroller board 48. The microcontroller board 48 may then either shut down the machine 10 so that the problem may be fixed or signal the manufacturer via the communication board 108 that the machine 10 needs to be serviced. In a like manner, any of the sensor inputs 74 may send a signal to the manufacturer when a malfunction has occurred.

The communication board 108 also allows the manufacturer to call into the machine 10. The manufacturer may want to call into each machine 10 on a daily basis to collect data as to the operation of the machine 10. For example, the manufacturer may want to collect data on how much ice each machine 10 has produced.

It should be noted that the telephone connection 110 does not need to be a dedicated phone line. The telephone connection 110 may be shared with any phone line in the store. However, the phone line should probably be a low use phone line such as a fax line or the like.

The monitoring and communication system 46 also has an audible announcement board 112 coupled to the microcontroller board 48. The audible announcement board 112 plays audible messages via a speaker 114. The audible announcement board 112 may be programmed to play any of a number of different messages. For example, the audible announcement board 112 may play commercials telling shoppers what the store has on sale. The audible announcement board 112 may be programmed to function with the sensors. Thus, for example, the audible announcement board 112 may tell people that the door 108 is open, that the panel 106 is open, or that the machine 10 needs to be serviced.

The monitoring and communication system 46 may further have a display 114. The display 114 is used to show information relating to operating conditions of the machine 10. The display would mainly be used by service representatives to see what sensor inputs 74 have been activated and what needs to be serviced. The display 114 may be a touchscreen display which would allow the service representative to scroll through various menus which would store data on the machine 10.

While the invention has been particularly shown and described with reference to preferred embodiments thereof, it will be understood by those skilled in the art that the foregoing and other changes in form and details may be made therein without departing from the spirit and scope of the invention.

What is claimed is:

1. A machine that produces, dispenses and automatically bags ice comprising, in combination:

at least one ice producing unit which produces ice;

an auger mechanism coupled to the ice producing unit for collecting and moving the ice;

a volumetric drum coupled to the auger mechanism which stores the ice moved by the auger mechanism and measures the amount of ice to be bagged by volume;

a bagging mechanism coupled to the volumetric drum which provides, supports, and opens a bag to be loaded with the ice when the volumetric drum has been loaded with a predetermined amount of ice;

a heat sealer coupled to the bagging mechanism which seals the bag once the bag has been loaded with ice;

a freezer compartment which stores the bag when the bag has been loaded with ice and sealed;

a monitoring and communication system which monitors operating conditions of the machine and sends information on the operation of the machine to the manufacturer; and a filtration system coupled to the at least one ice producing unit for removing contaminates which may be found in the water supply.

2. A machine that produces, dispenses and automatically bags ice further in accordance with claim 1 wherein the filtration system comprises an ultraviolet filter for eliminating bacteria which may be found in the water supply.

3. A machine that produces, dispenses and automatically bags ice in accordance with claim 1 further comprising a sump pump assembly for collecting water which may drain from the machine and for transporting the collected water to a floor drain.

4. A machine that produces, dispenses and automatically bags ice in accordance with claim 1 further comprising a plurality of ice producing units.

5. A machine that produces, dispenses and automatically bags ice in accordance with claim 1 further comprising a kicker mechanism coupled to the volumetric drum for depositing the bag on either side of the freezer compartment.

6. A machine that produces, dispenses and automatically bags ice in accordance with claim 1 wherein the auger mechanism comprises:

a channeling coupled to the at least one ice producing unit for collecting ice produced by the at least one ice producing unit;

at least one shank coupled to an interior section of the channeling for leveling and moving the ice collected in the channeling; and at least one auger motor coupled to the at least one shank for rotating the at least one shank to level and move the ice in the channeling.

7. A machine that produces, dispenses and automatically bags ice in accordance with claim 1 wherein the bagging mechanism comprises:

a plurality of rolls of bags;

a first bagging motor for rotating the plurality of rolls of bags to advance a next bag to be loaded with ice; and a blower which opens the bag so the bag may be loaded with ice.

8. A machine that produces, dispenses and automatically bags ice in accordance with claim 1 wherein the monitoring and communication system comprises:

a power supply;

a processor coupled to the power supply for controlling operation of the monitoring and communication system;

a heat controller coupled to the processor for activating and deactivating a heating element in the heat seal bar;

a motor controller coupled to the processor for activating and deactivating a plurality of motors in the machine; and a plurality of sensors coupled to the processor for monitoring operating conditions of the machine.

9. A machine that produces, dispenses and automatically bags ice in accordance with claim 8 wherein the monitoring and communication system further comprises a display screen coupled to the processor for visually seeing data collected by the monitoring and communication system.

10. A machine that produces, dispenses and automatically bags ice in accordance with claim 8 wherein the monitoring and communication system further comprises a communication module for allowing data to be transferred to and from the machine to the manufacturer of the machine.

11. A machine that produces, dispenses and automatically bags ice in accordance with claim 8 wherein the monitoring and communication system further comprises an audible announcement system coupled to the processor for providing audible announcements from the machine.

12. A machine that produces, dispenses and automatically bags ice in accordance with claim 11 wherein the audible announcements from the machine are advertisements.

13. A machine that produces, dispense and automatically bags ice in accordance with claim 11 wherein the audible announcements from the machine are announcements relating to an operating condition of the machine.

14. A machine that produces, dispenses and automatically bags ice in accordance with claim 8 wherein the motor controller comprises:

an AC motor controller coupled to the processor for activating and deactivating a plurality of AC motors of the machine;

a bag feed motor controller coupled to the processor for activating and deactivating a motor used in the bag feed mechanism; and a heat seal motor controller coupled to the processor for activating and deactivating a motor used in the heat sealer.

15. A machine that produces, dispenses and automatically bags ice in accordance with claim 14 wherein the AC motor controller controls the activating and deactivation of motors used in the auger mechanism, volumetric drum, and a bagging mechanism.

16. A machine that produces, dispenses and automatically bags ice in accordance with claim 8 wherein the plurality of sensors comprises a plurality of heat sealer sensors to monitor the operating condition of the heat sealer.

17. A machine that produces, dispenses and automatically bags ice in accordance with claim 16 wherein the plurality of heat sealer sensors comprises:

a heat seal temperature sensor coupled to the processor for monitoring a temperature of the heat sealer;

a heat seal in sensor coupled to the processor to monitor when the heat sealer is proper closed around a bag of ice to be sealed; and a heat seal out sensor coupled to the processor to monitor when the heat sealer has opened to release the bag of ice which has been sealed.

18. A machine that produces, dispenses and automatically bags ice in accordance with claim 8 wherein the plurality of sensors comprises a freezer temperature sensor coupled to the processor for monitoring a temperature in the freezer compartment.

19. A machine that produces, dispenses and automatically bags ice in accordance with claim 8 wherein the plurality of sensors comprises an ice falling sensor coupled to the processor for monitoring that the at least one ice producing unit is producing ice and that the ice is being deposited into the auger mechanism.

20. A machine that produces, dispenses and automatically bags ice in accordance with claim 8 wherein the plurality of sensors comprises a plurality of bagging mechanism sensors to monitor the operating condition of the bagging mechanism.

21. A machine that produces, dispenses and automatically bags ice in accordance with claim 20 wherein the plurality of bagging mechanism sensors comprises:

a bag open sensor coupled to the processor for monitoring if the bag is open and ready to be loaded;

a bag present sensor coupled to the processor for monitoring if the bag has been properly deposited into the freezer compartment;

a bag bottom sensor coupled to the processor for monitoring if a next bag to be loaded has been properly advanced; and a bag out sensor coupled to the processor for monitoring when the machine is out of bags.

22. A machine that produces, dispenses and automatically bags ice in accordance with claim 8 wherein the plurality of sensors comprises a volumetric drum sensor coupled to the processor for monitoring the level of ice in the volumetric drum.

23. A machine that produces, dispenses and automatically bags ice in accordance with claim 8 wherein the plurality of sensors comprises:

a merchandiser full sensor coupled to the processor for monitoring the level of ice in the freezer compartment and signaling the processor when the freezer compartment is full; and a merchandiser low sensor coupled to the processor for monitoring the level of ice in the freezer compartment and signaling the processor when the freezer compartment is low and that the machine 10 should start producing and bagging ice.

24. A machine that produces, dispenses and automatically bags ice in accordance with claim 8 wherein the plurality of sensors comprises a water present sensor coupled to the processor for signaling when a water level in a containment reservoir has reached a threshold level.

25. A machine that produces, dispenses and automatically bags ice in accordance with claim 8 wherein the plurality of sensors comprises:

door open sensor coupled to the processor for signaling when a door of the machine is open; and a panel open sensor coupled to the processor for signaling when a panel of the machine is open.

* * * * *